US010760435B2

(12) United States Patent
Dawson et al.

(10) Patent No.: US 10,760,435 B2
(45) Date of Patent: Sep. 1, 2020

(54) LOCK PLATE FOR A BLADED ROTOR ARRANGEMENT

(71) Applicant: ROLLS-ROYCE plc, London (GB)

(72) Inventors: John Dawson, Derby (GB); Ram Bhadresa, Derby (GB)

(73) Assignee: ROLLS-ROYCE plc, London (GB)

( * ) Notice: Subject to any disclaimer, the term of this patent is extended or adjusted under 35 U.S.C. 154(b) by 299 days.

(21) Appl. No.: 15/457,174

(22) Filed: Mar. 13, 2017

(65) Prior Publication Data

US 2018/0230830 A1 Aug. 16, 2018

(30) Foreign Application Priority Data

Mar. 16, 2016 (GB) ..... 1604473.7

(51) Int. Cl.
*F01D 5/30* (2006.01)
*F01D 5/32* (2006.01)
*F01D 5/18* (2006.01)

(52) U.S. Cl.
CPC ..... *F01D 5/3015* (2013.01); *F01D 5/18* (2013.01); *F01D 5/326* (2013.01);
(Continued)

(58) Field of Classification Search
CPC .... F01D 5/326; F01D 5/3015; F05D 2240/55; F05D 2260/30; F05D 2260/36; F05D 2220/32
See application file for complete search history.

(56) References Cited

U.S. PATENT DOCUMENTS 3,319,929 A * 5/1967 Lawrence ..... F01D 5/10 188/381
3,656,865 A * 4/1972 Spears, Jr. ..... F01D 5/3015 416/221

(Continued)

FOREIGN PATENT DOCUMENTS

FR 2710103 A1 3/1995
GB 1502549 A 3/1978
GB 1585186 A 2/1981

OTHER PUBLICATIONS

Jun. 10, 2016 Search Report issued in Great Britain Patent Application No. 1604473.7.

(Continued)

*Primary Examiner* — Peter J Bertheaud
*Assistant Examiner* — Geoffrey S Lee
(74) *Attorney, Agent, or Firm* — Oliff PLC

(57) ABSTRACT

Described is a turbine arrangement of a gas turbine engine, the turbine comprising: a rotor comprising a disc which incorporates a plurality of circumferentially spaced turbine blades, each blade having an aerofoil extending for a platform and a root portion securing the blade to the disc, a lock plate located at an axial end of the root portion of the blade, the lock plate comprising: a plate body having an inward facing surface which is located adjacent the blade root and an outward facing surface, radially inner and outer edge portions, and first and second circumferential edges; a head located at the radially outer edge portion of the plate body; a foot portion located at the radially inner portion of the plate body; a projection extending from the outwardly facing surface away from the turbine blade root in use, the projection being located adjacent to the foot portion, wherein the (Continued)

foot portion and head portion are located within slots provided at least partially by the disc and turbine blade respectively.

15 Claims, 4 Drawing Sheets

(52) U.S. Cl.
CPC ..... *F05D 2220/32* (2013.01); *F05D 2240/55* (2013.01); *F05D 2260/20* (2013.01); *F05D 2260/30* (2013.01); *F05D 2260/36* (2013.01)

(56) References Cited

U.S. PATENT DOCUMENTS 3,814,539 A * 6/1974 Klompas ..... F01D 5/081 416/95
4,171,930 A * 10/1979 Brisken ..... F01D 5/3015 416/193 A
4,189,282 A * 2/1980 Benoist ..... F01D 5/3015 416/193 A
4,247,257 A * 1/1981 Benoist ..... F01D 5/3015 416/220 R
4,480,959 A * 11/1984 Bourguignon ..... F01D 5/26 416/145
7,500,832 B2 * 3/2009 Zagar ..... F01D 5/3015 416/220 R
8,226,366 B2 * 7/2012 Brucher ..... F01D 5/3015 416/219 R
2008/0181767 A1 * 7/2008 Brillert ..... F01D 5/081 415/170.1
2009/0092497 A1 4/2009 Boeck
2009/0110561 A1 * 4/2009 Ramerth ..... F01D 5/082 416/96 R
2012/0148406 A1 * 6/2012 Halfmann ..... F01D 5/085 416/95
2014/0119917 A1 * 5/2014 Tarczy ..... F01D 5/22 416/140
2014/0119943 A1 * 5/2014 Tarczy ..... F01D 5/3069 416/96 R
2016/0169014 A1 * 6/2016 Beaujard ..... F01D 5/3015 415/209.3
2016/0169024 A1 * 6/2016 Beaujard ..... F01D 5/3015 416/174
2016/0230579 A1 * 8/2016 Schwartz ..... F01D 11/005
2017/0009595 A1 * 1/2017 McCaffrey ..... F01D 11/003
2017/0058912 A1 * 3/2017 De Gaillard ..... B29B 11/16

OTHER PUBLICATIONS

Jul. 26, 2017 Search Report issued in European Patent Application No. 17 16 0028.

* cited by examiner

LOCK PLATE FOR A BLADED ROTOR ARRANGEMENT

TECHNICAL FIELD OF INVENTION

The present invention relates to a bladed rotor arrangement and an associated lock plate. In particular, the invention relates to a bladed rotor arrangement of a turbine stage of a gas turbine engine or a turbomachine.

BACKGROUND OF INVENTION

Gas turbine engines comprise a plurality of bladed rotors, each of which comprises a rotor, typically in the form of a disc, and a plurality of rotor blades circumferentially mounted around the radial periphery of the rotor. Each rotor blade has an aerofoil, a platform, a shank and a root. The rotor comprises a plurality of circumferentially spaced axially extending slots defined by radially extending posts. The root of each rotor blade is arranged to locate in a respective one of the axially extending slots. The roots of the rotor blades are generally fir tree or dovetail shaped and the axially extending slots are correspondingly shaped to receive the roots of the rotor blades. The engagement of the roots in the slots is sufficient to radially retain the blades when under centrifugal loading induced during rotation of the rotor.

The bladed rotor arrangement also comprises a plurality of lock plates arranged at either or both axial ends of the rotor to prevent the rotor blades moving axially relative to the rotor. The lock plates also act to restrict fluid flowing under the platform of the blades.

The radially outer ends of lock plates typically engage grooves provided in the radially inward facing surfaces of the blade platforms, or flanges extending therefrom. The radially inner ends of the lock plates engage circumferentially extending grooves in the rotor or slots defined by additional structural members such as so-called cover plates or and seal plates.

In the case of a turbine stage lock plate, the components are exposed to extreme temperatures and pressures, and high levels of centrifugal loading as the rotor spins. And of course, the lock plates are required to maintain the requisite functionality whilst withstanding these extreme forces placed on the components.

The lock plates are designed to be undersized in a cold build condition to allow for operational movement resulting from thermal expansion and centrifugal forces, and also to allow for manufacturing tolerances and build clearances.

Further, the centrifugal loading is ultimately carried by the blade platform grooves in which the radially outer edges of the lock plates are located. Thus, there is a general requirement to minimise the mass of the lock plates to help reduce the resultant parasitic loading on the blades and any other associated components.

The present invention seeks to provide an improved bladed rotor arrangement and associated lock plate.

STATEMENTS OF INVENTION

The present invention provides a turbine arrangement and a lock plate according to the appended claims.

According to the present disclosure there is a turbine arrangement of a gas turbine engine may comprise: a rotor comprising a disc which incorporates a plurality of circumferentially spaced turbine blades, each blade having an aerofoil extending for a platform and a root portion securing the blade to the disc, a lock plate located at an axial end of the root portion of the blade, the lock plate comprising: a plate body having an inward facing surface which is located adjacent the blade root and an outward facing surface, radially inner and outer edge portions, and first and second circumferential edges; a head located at the radially outer edge portion of the plate body; a foot portion located at the radially inner portion of the plate body; a projection extending from the outwardly facing surface away from the turbine blade root in use, the projection being located adjacent to the foot portion, wherein the foot portion and head portion are located within slots provided at least partially by the disc and turbine blade respectively.

Providing a projection extending from the outwardly facing surface and local to the foot portion of the lock plate, allows the centre of gravity of the lock plate to be axially spaced from the turbine blade root relative to the geometric centre of the lock plate or a pivot point defined by the head portion. Thus, in use, the lock plate moves away from the turbine blade root when centrifugally loaded.

The head portion may include one or more pads. The pads may extend from the radially outer edge of the plate body. The pads may provide a pivot point for pivotally abutting or engaging a corresponding formation on the blade platform.

The foot portion slot may be provided by an axially inner wall and an axially outer wall, the foot portion slot being therebetween, and the projection is provided radially proximate to a radially outer periphery of the axially outer wall.

The disc slot may be at least partially provided by a seal plate or a cover plate which is attached to the rotor. The seal plate may define a channel between the seal plate and the rotor. The channel may form part of a fluid pathway for delivering cooling air to a turbine component. The fluid pathway may extend between a compressor stage of the gas turbine engine and an internal cooling passage of the rotor blade.

The axial extent of the projection may be greater than the outer wall of the disc slot.

The radial separation of the projection and the radial periphery of the axially outer wall of the disc slot may be in the range of between 2 mm and 4 mm. The radial separation may be taken when the engine is cold. The nominal cold clearance may be approximately 2.8 mm.

The blade slot may be provided in the radially inner face of a blade platform.

The blade slot may include a pivot pad which radially opposes a pivot pad on the radial periphery of the lock plate head portion.

The projection may be an elongate rib protruding from the outwardly facing surface. The projection may be circumferentially continuous or may be circumferentially segmented.

The rib may be circumferentially curved. The rib may extend between the circumferential edges of the lock plate. The radius of curvature of the rib may be concentric with the principal axis of the rotor.

The foot portion may include a seal fin located in the disc slot The projection may be located radially outwards of the seal fin.

The seal fin may include a chordal inner edge. The chordal edge may be substantially straight. The chord may be a chord of a circle centred on the rotational axis of the turbine.

The seal fin may be thinner than the plate body in transverse section.

The seal fin may be axially thinner than the plate body.

The head portion may include one or more pivot pads on a radially outer edge thereof. There may be a central pivot pad. There may be a pivot pad at each circumferential edge of the lock plate. The pivot pads at the circumferential edge of the lock plates may be half the circumferential length of the central pivot pads.

The radially outer edge of the lock plate may include a chamfer on either or both of the outwardly facing surface or the inwardly facing surface, the pivot pad being defined by the chamfer.

According to the present disclosure there is a lock plate for covering the root of a turbine blade in a gas turbine engine, may comprise: a plate body having an inward facing surface which is located adjacent the blade root and an outward facing surface, radially inner and outer edge portions, and first and second circumferential edges; a head portion located at the radially outer edge portion of the plate body; a foot portion located at the radially inner portion of the plate body; a projection extending from the outwardly facing surface away from the turbine blade root in use, the projection being located adjacent to the foot portion.

Within the scope of this application it is expressly envisaged that the various aspects, embodiments, examples and alternatives, and in particular the individual features thereof, set out in the preceding paragraphs, in the claims and/or in the following description and drawings, may be taken independently or in any combination. For example features described in connection with one embodiment are applicable to all embodiments, unless such features are incompatible.

In the description below, unless otherwise stated, the geometric references for axial and circumferential should be taken with reference to the principal axis of the gas turbine engine. The terms upstream and downstream should be taken with reference to the flow stream of the main gas path through the engine. Inward and outward facing surfaces should be taken with reference to the rotor surfaces.

DESCRIPTION OF DRAWINGS

Embodiments of the invention will now be described with the aid of the following drawings of which.

DETAILED DESCRIPTION OF INVENTION

Figure 1:
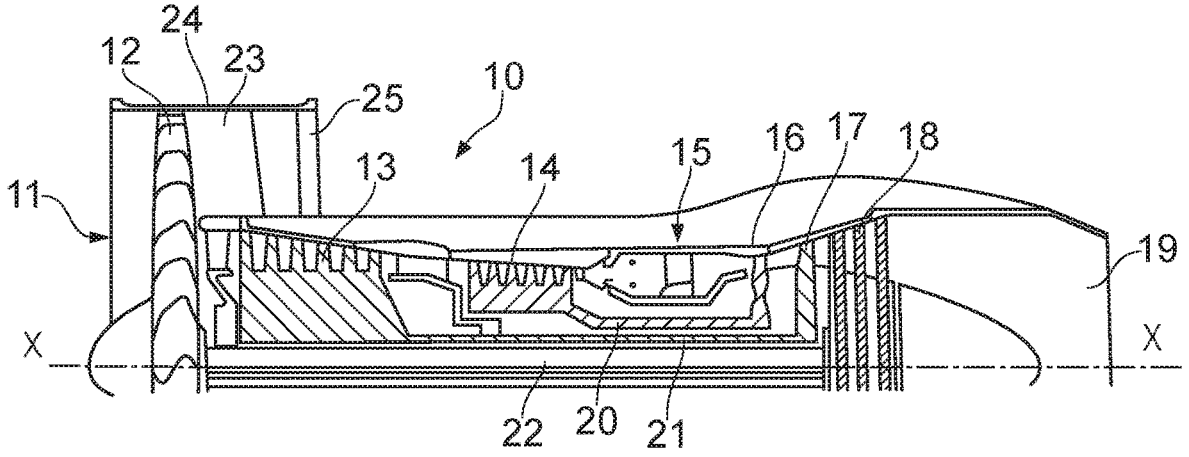
FIG. 1 shows a schematic longitudinal section of a conventional gas turbine engine.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 20. The intermediate pressure turbine 17 is arranged to drive the intermediate pressure compressor 13 via a second shaft 21 and the low pressure turbine 18 is arranged to drive the fan 12 via a third shaft 22. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine and flows through a bypass duct 23 defined by a fan casing 24. The second portion of air leaving the bypass duct 23 flows through a bypass, or fan, nozzle 25 to provide propulsive thrust.

Figure 2:
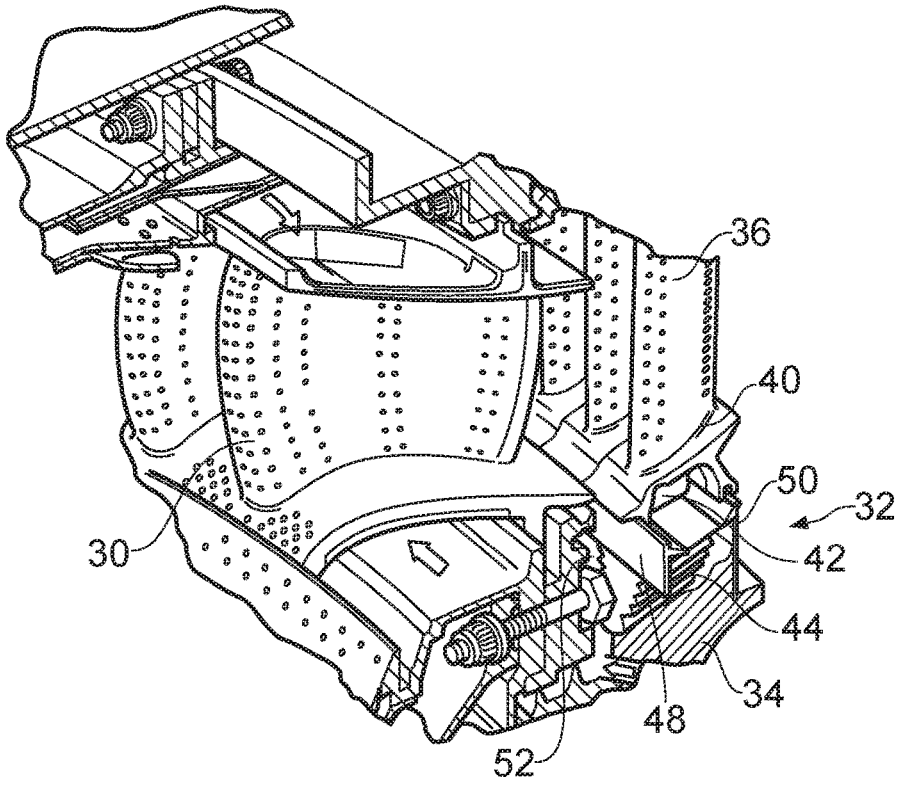
FIG. 2 shows an isometric view of a high pressure turbine stage of a gas turbine engine, with a cut out to reveal a lock plate assembled in the rotor arrangement.

A portion of the high pressure turbine 16 of the turbofan gas turbine engine 10 is shown more clearly in FIG. 2. The high pressure turbine 16 comprises a plurality of nozzle guide vanes 30 which guide hot gases from the combustion chamber 15 onto the turbine rotor blades 36 of a bladed turbine rotor arrangement 32. The bladed turbine rotor arrangement 32 comprises a turbine rotor 34, a plurality of turbine rotor blades 36 and a plurality of lock plates 48 and 50. The turbine rotor blades 36 are mounted on the periphery of the turbine rotor 34 and each turbine rotor blade 36 comprises an aerofoil, a platform 40, a shank 42 and a root 44.

The turbine rotor 34 comprises a plurality of circumferentially spaced axially extending slots 46 defined by disc posts 52. The root 44 of each turbine rotor blade 36 locates in a respective one of the axially extending slots 46 in the periphery of the turbine rotor 34. The turbine rotor 34 in this example comprises a turbine disc. The roots 44 of the turbine rotor blades 36 are generally fir tree shaped and the axially extending slots 46 are correspondingly shaped to receive the roots 44 of the turbine rotor blades 36. However, the roots 44 of the turbine rotor blades 36 may be dovetail shaped and the axially extending slots 46 shaped accordingly.

Lock plates 48, 50 are included at the axial extents of the disc posts 52 which define the root receiving axially extending slots. The lock plates 48, 50 provide a retaining function to prevent axial movement of the blades relative to the disc, and a sealing function to help reduce fluid flow under the blade platform and around the blade roots. An uncontrolled flow in this area would lead to excessive use of cooling air (which ultimately reduces efficiency) and deleterious levels of poorly distributed cooling air.

Figure 3:
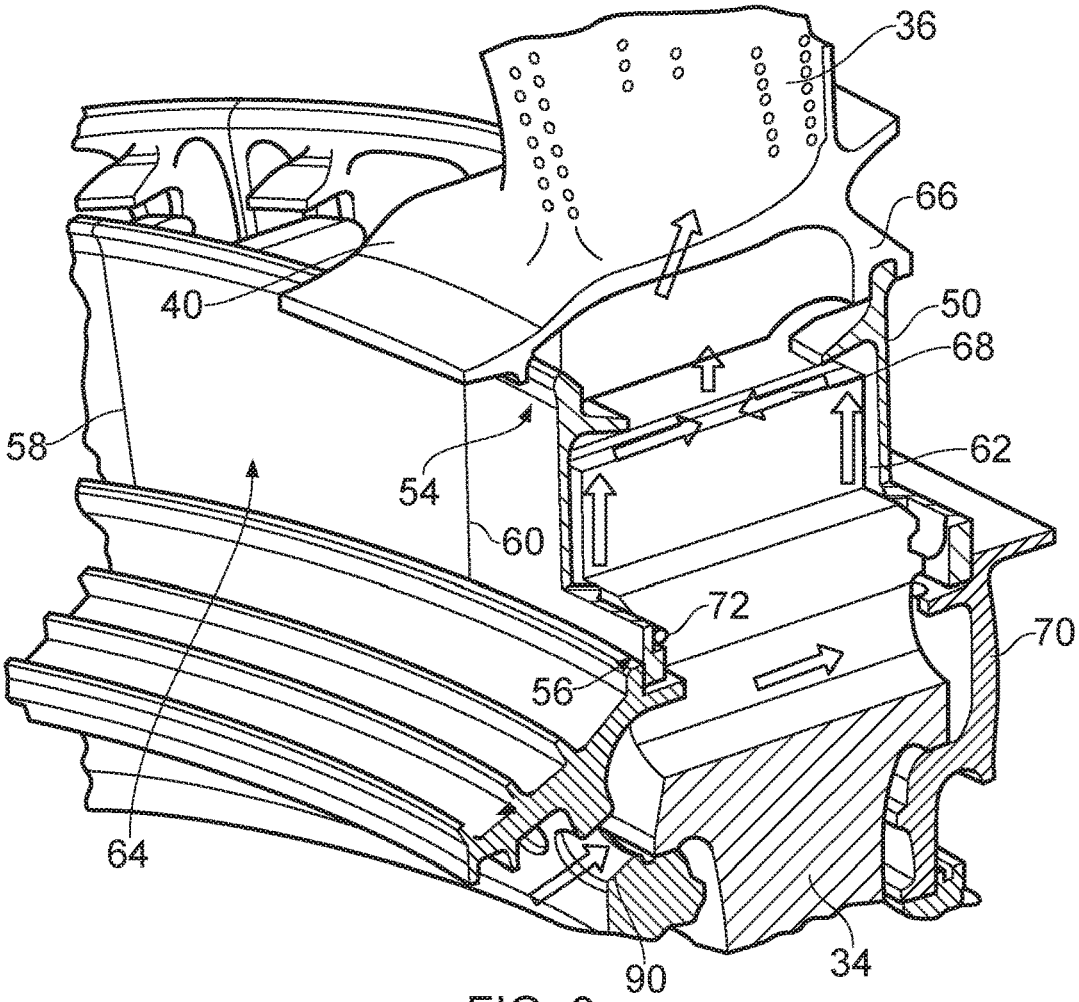
FIG. 3 shows a detailed isometric view of a rotor arrangement including a lock plate.

FIG. 3 shows a more detailed partial section of a turbine section, similar to that shown in FIG. 2. The turbine section is a high pressure turbine having a plurality of circumferentially arranged turbine blades 36 in flow series with a vane set.

The lock plates 48, 50 are plate-like members having a generally flat or planar body defined by a radially outer portion 54, a radially inner portion 56 and two circumferential edges 58, 60 which extend between the radially inner 56 and outer portions 54. The lock plates 48, 50 are arranged in a circumferentially distributed manner and abut one another to provide a full annulus shield around the disc posts and blade roots. The lock plates 48, 50 are located adjacent the blade roots 44 and disc posts 52 so as to have an inwardly facing surface 62 and an outwardly facing surface 64. The radially inner 56 and radially outer 54 portions of the lock plates 48, 50 include respective head and foot portions.

In relation to the aft or rear lock plate 50 it can be seen that the head portion is located in a groove provided be an inwardly extending flange 66 provided on the radially inner surface of the platform 40. The foot portion is located in the groove defined between the disc posts and a seal plate 70. The fore lock plate 48 includes a similar arrangement on the upstream side of the rotor.

Under operating conditions the lock plates 48, 50 are rotated with the rotor 34 and experience a radial centrifugal force. This force causes the lock plates 48, 50 to move radially outboard and into the grooves provided by the blade platform 40. The mass distribution of the lock plates 48, 50 and the centrifugal force is such that the lock plates tend to pivot about the head portion 54. The amount of rotation, or the rotational force, is dependent on the centre of gravity of the lock plates relative to the pivot point. With existing designs, the centre of gravity is such that the lock plates 48, 50 move towards, or inwardly to, the discs for both the forward and rear lock plates. Although this can have advantageous effects, it can also act to open up a gap between the seal plate and the lock plates which can provide an unwanted leakage path for cooling air 68 which is both outside of the lock plates, and being channeled within the lock plates, for the interior passages of the blade and platforms.

To help reduce the centrifugally induced moment, it is possible to provide some axial biasing. Such axial biasing may be provided by a spring wire 72 or the like located at an appropriate location between the lock plate 48 and disc 34. Such a biasing mechanism ultimately adds unnecessary complication and potential points of failure to the rotor arrangement and is not ideal.

Figure 4:
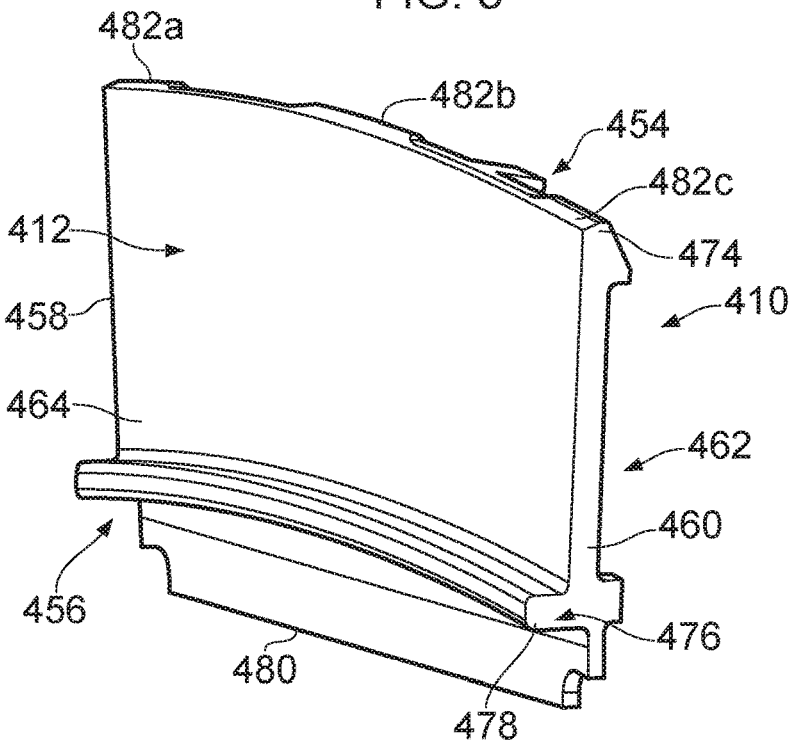
FIG. 4 shows an isometric view from an outward direction of a lock plate according to the invention.

FIG. 4 shows an isometric view of a lock plate 410 having a plate body 412 with an inward facing surface which is located adjacent the blade root (and obscured from view in FIG. 4) and an outwardly facing surface 464 which faces away from the blade and disc. The lock plate 410 includes radially inner 456 and outer 454 edge portions and first 458 and second 460 circumferential edges which extend between the radially inner 456 and outer 454 edge portions.

The radially outer edge portion 454 of the plate body 412 includes a head portion 474. The radially inner portion 456 includes a foot portion 476. A projection extends 478 from the outward facing surface 464 of the lock plate 410 away from the turbine blade roots. The projection 478 may take any form which sits proud of the planar surface of the lock plate and substantially moves the centre of gravity axially away from the blade against which it is located. Further, the projection terminates axially beyond the pivot point of the lock plate such that its mass causes the lock plate to move away from the blade under CF loading. Thus, the projection may be one or more outstands or protrusions extending away from the surface of the lock plate.

As can be seen in FIG. 4, the projection may be in the form of an elongate rib which extends from a fixed end attached to the outwardly facing surface away from the lock plate to a free end. The projection 478 may be perpendicular to the outwardly facing surface 464. The elongate rib has a longitudinal axis which extends between the circumferential edges of the plate body. In the example shown, the ends of the rib are coterminous with the circumferential edges of the plate, but this need not be the case and the projection may terminate short of the edges. Further, there may be a plurality of discrete projections distributed across the outward face of the lock plate 410.

The rib is longitudinally curved with a radius of curvature which is concentric with the principal axis of the rotor. The radially outer edge of the lock plate is similarly curved in the example shown, having a origin of curvature which is also concentric with the principal axis of the rotor.

The purpose of the projection is to move the centre of gravity away from the rotor relative to a pivot point located on a head portion. Thus, the radial position and the radial and axial extent of the projection is determined as a function of the material density and desired centre of gravity and the pivot point provided by the head portion 474. This is described in more detail below.

Although the head portion 474 as shown in FIG. 4 is circumferentially curved, the radially inner edge of the foot portion has a chordal edge 480. By chordal edge it will be understood that the radially inner edge foot portion 456 is a straight line which is defined by a chord of a curve centred local to the principal axis of rotor. An advantage of the chordal edge is that it provides an increased sealing engagement with a cover plate against which it abuts when rotated and the centrifugal force. It will be appreciated that the chordal line of the radially inner edge is substantially straight and may include some minor deviation from straight, either locally or along its length.

The rib 478 is integrally formed with the lock plate so as to provide a single homogenous structure, for example, by casting or machining from stock. However, there may be instances where the rib is formed as a separate part and attached to the lock plate body by a suitable method of attachment.

In the example shown, the lock plate head portion is provided with three separate pivot pads 482*a-c* which are circumferentially distributed along the radially outer edge. There are two circumferentially outer pads 482*a*, 482*c*, and one central pad 482*b* located more or less equidistantly between the two outer pads. The two outer pads extend from the respective circumferential edges of the plate body and have approximately half the circumferential length of the central pad such that when two similar lock plates are placed adjacent to each other they form a single pad which is similarly sized to the central pad. It will be appreciated that other configurations of pads may be possible and the circumferential extent and width of the pads will be dependent on the pivoting action which is required. In other examples there may be a greater or fewer number of pivot pads, and they may or may not be evenly distributed around the circumferential edge of the lock plate.

The individual pivot pads are provided by rebates in the radially outer edge of the head portion. That is, the peripheral edge of the radially outer portion of the lock plate is indented to provide the pads in the form of upstands.

Figure 5:
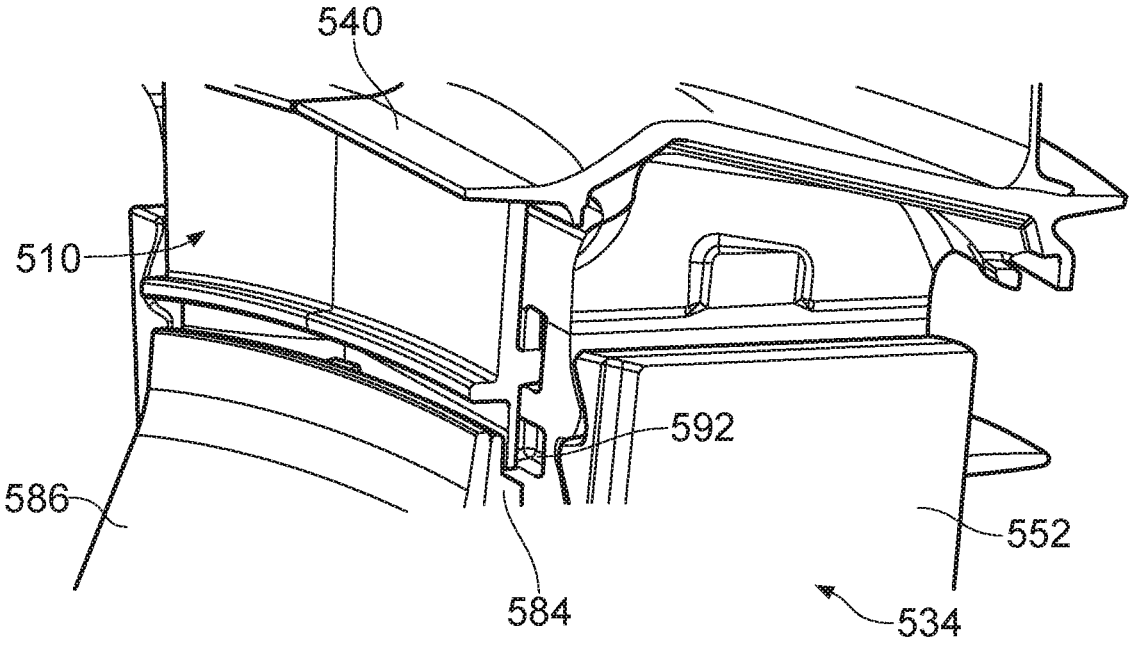
FIG. 5 shows the lock plate of FIG. 4 located in a rotor arrangement.

FIG. 5 shows the lock plate of FIG. 4 in situ. Hence, moving radially outwards there is shown a turbine disc 534 of which a disc post can be seen, a front seal plate 584, a front cover plate 586, a lock plate 510, and a turbine blade platform 540. The lock plate 510 is located adjacent to and upstream or forward of the rotor 534 and sits in front of the rotor disc posts 552 and blade roots and shank and is held in a plane which is normal to the principal axis of the rotor and engine.

The lock plate 510 is held in grooves/slots provided by the turbine blade at the radial outer, and in the rotor disc 534 at the radial inner. In the example, the radially outer groove is defined at least partially by the turbine blade, in particular, the turbine platform. The radially inner groove is defined at least partially by a seal plate 584. It will be appreciated, that the radially outer and radially inner lock plate retention grooves may be provided by alternative structure. Such structure may include a slotted flange for example.

The seal plate 584 is positioned at the upstream axial end of the turbine rotor 534. It comprises an annular disc having an inner and outer radius, and inwardly and outwardly facing surfaces, the former of which faces inwardly towards the rotor and abuts the upstream disc surface. A separate seal plate may be provided on the downstream side of the rotor 534.

The seal plate 584 is axially retained by a cover plate 586. The cover plate 586 is fixed to the rotor shaft or an associated member so as to form part of the rotor. The cover plate 586 is an annular structure having an inner bore (not shown) through which a shaft passes. The cover plate 586 also provides a heat shield for the seal plate 584.

The seal plate 584 provides a sealing function and helps guide cooling air from an aperture 90 (see FIG. 5) in the cover plate and into the inlet 592 of the turbine blade cooling passages which is located in the base of the turbine root. The seal plate may define a channel between the seal plate and the rotor. The channel may form part of a fluid pathway for delivering cooling air to a turbine component. The fluid pathway may extend between a compressor stage of the gas turbine engine and an internal cooling passage of the rotor blade.

It will be appreciated that other arrangements may be possible and the cover plate and seal plate are both individually optional. In such a case, the lock plate may be retained in a slot provided by an appendage of disc. Such an appendage may be a flange or other mass which is integrally formed with disc.

Figure 6:
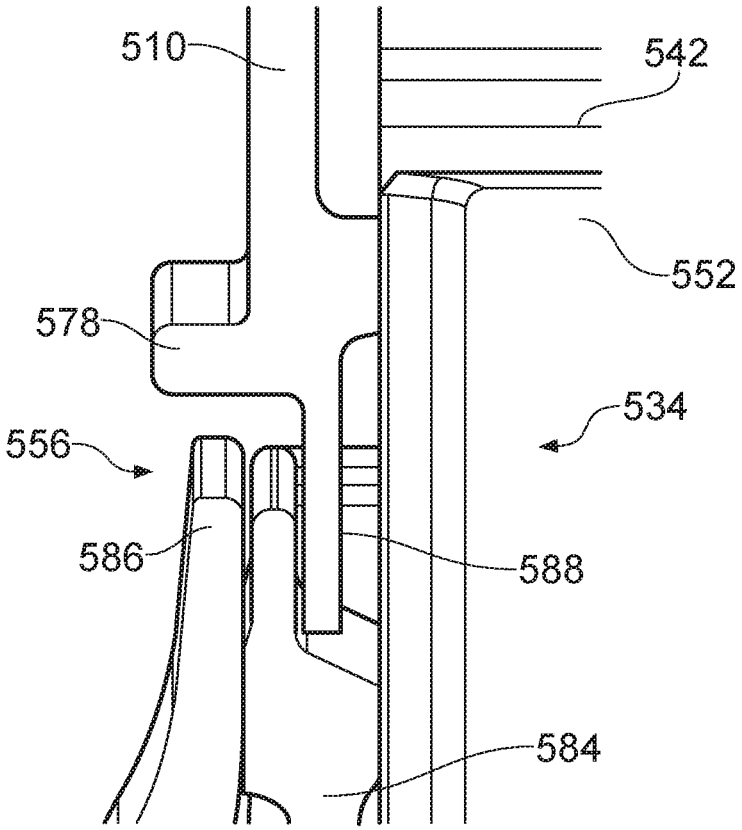
FIG. 6 shows a partial section of FIG. 5 to illustrate the features of the radially inner portion of the lock plate.

FIG. 6 shows a partial longitudinal section of the foot portion 556 of the lock plate 510 which details the front cover plate 586, seal plate 584, lock plate foot portion and turbine disc post 552. The lock plate is held within a circumferential groove which has a radially outer open end, a radially inner terminal end and axially inner and outer walls The projection 578 provides a mass which acts to move the centre of gravity forwards or away from the disc relative to the geometric centre of the lock plate 510. The displacement of the centre of gravity is sufficient to cause the forward movement of the lock plate under normal operating centrifugal forces. Hence, in operation, the lock plate 510 is arranged to rock away from the rotor at the radially inner edge when pivoting under CF loads. Moving the lock plate forward at the radially inner portion in this way increases the sealing between the lock plate and the seal plate.

The forward movement of the lock plate 510 is provided by a rotation about a fulcrum located towards the radially outer edge of the lock plate 510. Specifically, in the described example, the lock plate pivots about the radially outer peripheral edge of the lock plate and pivot pads provided thereon. It will be appreciated that the head portion 554 of the lock plate may include the pivot at an edge thereof without the use of discrete pivot pads.

The outer peripheries, or outer radii in the described example, of the cover plate and seal plate are substantially similar in extent. Thus, they are approximately radially coterminous. A circumferential groove is provided between the seal plate 584 and the rotor disc 534 to receive a portion of the lock plate 510. To provide the groove, the seal plate may be spaced from the disc, or have a portion spaced from the disc. In the example shown, the seal plate 584 includes a rebate around the inwardly facing surface of the radially outer portion so as to provide a circumferentially extending groove. The disc 534 may also include some form of rebate in which to accommodate the lock plate 510.

The groove is generally annular and encircles the rotor around the periphery of the seal plate 584. The groove is substantially axially uniform in radial and circumferential directions and lies in a plane which is generally normal to the axis of rotation. However, it will be appreciated that there may be discontinuities in the groove to allow for anti-rotation or locating features for the lock plates 510.

The foot portion 556 of the lock plate 510 includes a seal fin 588 which extends from the radially innermost edge of the lock plate body. In the example shown, the seal fin 588 extends from the radially inner side of the rib 578. The seal fin 588 defines the circumferential extent of the lock plate 510 at the foot portion and provides the radially inner edge thereof.

The seal fin 588 lies within the circumferential seal groove provided by the disc surface and seal plate 584. As shown in the example, the seal fin 588 may lie in a plane normal to the rotational axis of the rotor 534 and may be in the same plane or parallel to the lock plate body. The seal fin 588 is spaced from the disc surface and proximate to, if not abutting, the inner surface of the seal groove provided by the seal plate 584. The seal fin 588 will abut the inner surface of the seal groove under CF loading when the lock plate rocks forward at the radially inner portion.

The axial thickness of the seal fin 588 may be less than the lock plate body and less than the seal groove in which it resides to provide the clearance with the disc surface. The axial location of the seal fin may be local to the geometric centre plane of the lock plate body. The radially inner edge of the seal fin 588 provides the chordal edge to the lock plate 584 which is described above in relation to FIG. 4.

The seal fin 588 may be provided by removing material from either or both of the outwardly facing surface and inwardly facing surface of the lock plate 510, for example, by grinding or otherwise machining. In the example, the inwardly facing surface of the lock plate 510 is provided with a cut-back or rebated portion from the radially inner edge to provide a step in the inwardly facing surface. The step provides a contact pad for the lock plate to contact the disc and provide axial location thereof and a clearance space to separate the seal fin from the disc surface.

In situ, the seal fin 588 is located between the seal plate 584 and the disc 534 surface so as to radially overlap one another in all normally expected operating conditions. Under the CF loading, the seal fin pivots forward and until the seal fin 588 abuts the opposing surface of the seal plate 584 and provides a flow path restriction or seal therebetween. The presence of the chordal edge to the seal fin aids the sealing function. The sealing contact force is increased when the lock plate is subject to CF loading in use.

The radial position of the lock plate at rest is provided by an abutment of the seal fin and the terminal end of the seal groove in the seal plate 584.

The rib 578 and the outer peripheral edges of the cover plate 586 and seal plate 584 are radially separated when the engine is at rest (at cold). The separation of the rib 578 and the plates is sufficient to allow for build tolerances and any expected in-service movements to prevent binding or unnecessary stress being induced on the lock plates or blade platforms. The radial separation of the periphery of the rotor outer wall and the projection may be in the range of between 2 mm and 4 mm. The nominal cold clearance may be approximately 2.8 mm.

Placing the rib 578 as close to the seal and cover plates as possible allows the separation of the projection and the fulcrum at the head portion to be maximised within the available radial constraint. This increases the effectiveness of the mass in moving the centre of gravity and controlling the movement of the lock plate. Hence, the closer the rib to the plates, or the further from the pivot pads, the smaller the projection can be thereby saving weight.

It is also to be noted that the radius of curvature of the outer periphery edge of the cover plate and the inner radius of the projection are concentrically aligned so that the separating gap is uniform along the circumferential length of the rib.

The exact size and spacing of the projection relative to the cover plate is determined by the architecture of the engine and the requirements of the CF loading as will be appreciated by the person skilled in the art. Small changes to the size and corresponding mass of the projection can have a significant effect on the axial force exerted on the foot portion. As will be appreciated, the lateral force on the foot portion, and lock plate generally, will determine the dimensions and ultimately the weight of the lock plate. Hence, careful optimisation of the position and size of the rib is preferred.

The axial extent of the rib 578, relative to the principle axis of the engine, is greater than the axial length of the cover plate 586. That is, the rib extends further upstream than the cover plate 586 and thereby provides an overhanging shield which helps protect the seal plate 584 and disc 534 from radiative heat emitted by the main gas wall.

A further advantage of providing a minimal separation between the rib and the outer rim of the cover plate is that it helps provide a tortuous path which further helps restrict any leakage flow path through which cooling air could escape.

Figure 7:
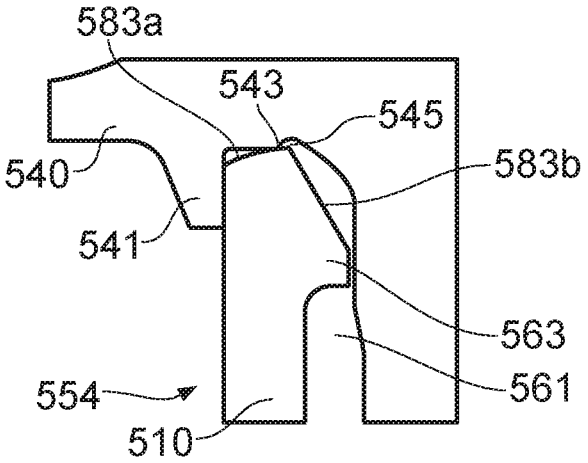
FIG. 7 shows a partial section of the radially outer portion of the lock plate and turbine blade platform.

FIG. 7 shows a detailed section of the head portion 554 of the lock plate 510. The head portion 554 of the lock plate is located in a groove provided in the radially inner surface of the turbine blade platform 540. The groove includes a radially inner open end, a radially outer terminal end and axially separated inner and outer walls. In the described example, the groove is formed between a flange 541 which extends radially inwards from the inner surface of the platform and provides outer wall, and a surface of the turbine blade 542 which provides the inner wall. The turbine blade surface may be provided by the shank of the blade or the root. It will be appreciated that the groove may be provided within the end of the flange as is shown in the axially downstream lock plate arrangement of FIG. 3.

The groove provides a circumferentially extending channel into which the head portion 554 of the lock plate 510 can be fitted and axially restrained in use. The groove is open ended from the radially inner direction and is generally annular being made up from the annular arrangement of similar turbine blades each having corresponding grooves provided in the underside of the platforms. The grooves have a radial component which is normal to the rotational axis of the rotor.

The internal surface 543 of the terminal end of the turbine platform groove is shaped to provide a pivot pad 545 which operationally engages with the corresponding pivot pad 582 of the head portion of the lock plate 510. The blade pivot pad 545 is provided by a step in the radially outer terminal end of the groove. The nose of the step extends circumferentially around the groove and is provided at an approximate axial mid-point thereof. The step is a change in radial extent at the terminal end of the groove and provides a pivot pad which is radially facing, and a riser which is axially facing. In the described example, the riser faces axially towards the disc surface to provide the pivot pad on the axially outer extent of the groove.

The pivot pad 545 of the turbine platform 540 extends across approximately half the axial length of the slot at which point there is provided a rebate in a radially outwards direction to provide the step. The pivot pad 545 extends from the inwardly extending flange of the platform axially rearwards towards the turbine shank. Providing a pivot pad 545 which is distinctly formed by a step allows the contact area of the pivot to be more accurately position and predicted in service. It will be appreciated, that the exact dimensions of the pivot pad and its axial extent relative to the slot, will be dependent on the head portion and requirements of the pivot.

The head portion 554 is provided by a peripheral edge of the lock plate body. The inside surface of the lock plate includes a scallop or indent 561 (as shown FIG. 8) which provides a circumferential wall 563 on the radially outer edge of the head portion. The wall is provided proximate to the turbine blade groove wall and restricts the amount of bladewards movement of the lock plate.

The head portion 554 has at least one pivot pad 582 which corresponds to the equivalent feature on the turbine platforms slot, such that, in unison, the two pads provide a pivot about which the lock plate 510 can turn.

The pivot pad 582 of the head portion 554 is provided at the radially extreme edge of the lock plate 510 and may be provided in a perpendicular orientation to the general plane of the lock plate. This outer peripheral edge of the head portion 554 has a pair of chamfers 583 *a, b* on the either side of the pivot pad 582 and which define the axial extent of the pivot pad 582. Thus, the chamfers 583*a,b* are located on the respective outer and inner surfaces of the lock plate body and provide a circumferentially extending surface which extends from the outer or inner surface and terminate at the respective end of the pivot pad 582. The axial component of the chamfers and resultant location of the pivot pad will be dependent on the turning moment which is required. In the example, the pivot pad 582 is located at an approximate geometric centre of the lock plate body.

The outer surface chamfer 583*a* of the head portion 554 lies at an angle to the outward surface of the lock plate in the range of approximately between seventy and eighty five degrees. The purpose of the chamfer 583*a* is to limit the size of pivot pad and provide a shoulder or line contact around which the lock plate can rotate against the pivot pad 543 of the turbine platform groove, and also to provide a clearance space for the lock plate to rotate in to.

The inner chamfer 583*b* of the head portion 554 has a steeper incline than the outer chamfer 583*a*, relative to the pivot pad. The angle of the chamfer may be in the range of between approximately twenty degrees to forty five degrees. This increased chamfer provides some clearance to allow the lock plate head portion to be inserted more easily in to the turbine platform slot.

When assembled the head portion is loosely located in the blade groove. The loose fitting results from the provision of axial clearance in the respective dimensions of the head portion and the blade groove. The clearance allows for ease of assembly and some differential thermal expansion during use. The head portion may have a clearance of between 0.6 mm and 0.2 mm in the axial direction. In some embodiments this will be controlled to approximately +/−0.2 mm in the axial direction.

When assembled, the pivot pads of the lock plate and the blade groove axially overlap. The extent of the overlap is determined by the relative sizes of the components but will regardless provide some variability in the position of the pivot pad. This overlap may provide a pivot point variability of between 1 mm and 0.5 mm.

The arrangement of the upstream chamfer 583*a* and pivot pad 582 are such that the location of the pivot can be accurately predicted in service when there is substantial movement of the parts relative to one another. This enables a more accurate modelling of the arrangement and more tailored design of the constituent parts. In the particular arrangement shown in FIG. 7, the pivot pad is approximately half of the thickness of the lock plate body axial thickness.

Figure 8:
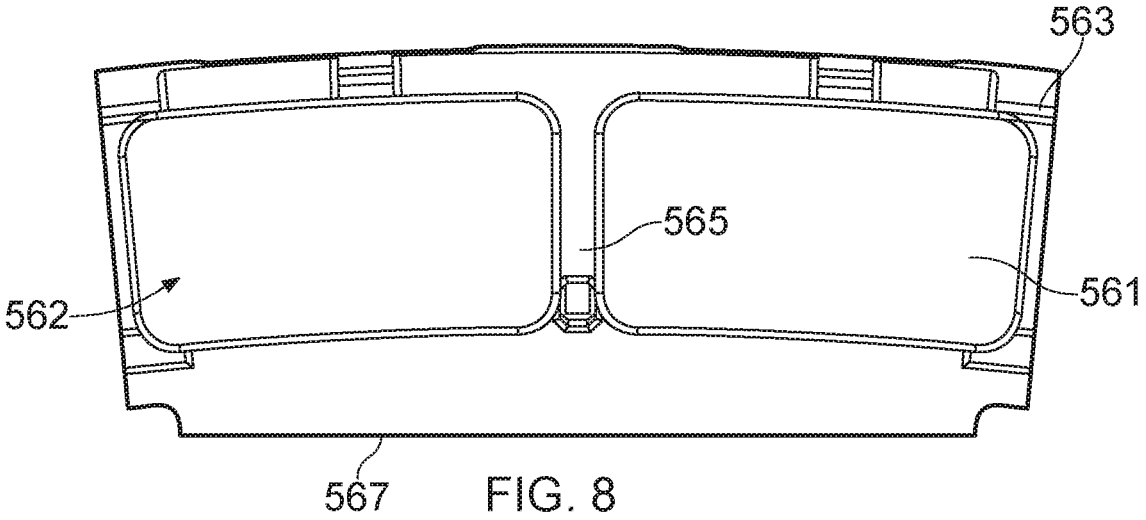
FIG. 8 shows an outwardly facing view of the inner disc facing surface of the lock plate.

FIG. 8 shows a rearward projection of the inner facing surface 562 of the lock plate 510 which is located adjacent the disc and turbine blade roots in use. The rearward surface 562 includes a plurality of indents or scallops which are defined by surrounding peripheral walls 563 along the radially inner and outer edges and the circumferential edges of the lock plate body. A mid-span radial wall 565 is provided between the radially inner and outer walls and located at circumferential mid-point. The walls increase the rigidity of the lock plate (or the indents remove weight from the part). The surfaces of the walls also provide abutment portions for the head and foot portions as described above.

The radially inner edge of the lock plate 510 as shown in FIG. 8 includes a chordal edge 567 in the form of a straight edge which extends between the circumferential edges of the lock plate. The chordal edge 567 increases the line contact between the seal plate and the seal fin under various operating conditions where relative movement may be experienced.

It will be appreciated that the chordal edge may not be perfectly straight and some minor variation may still perform a similar although perhaps not as optimum function.

Figure 9:
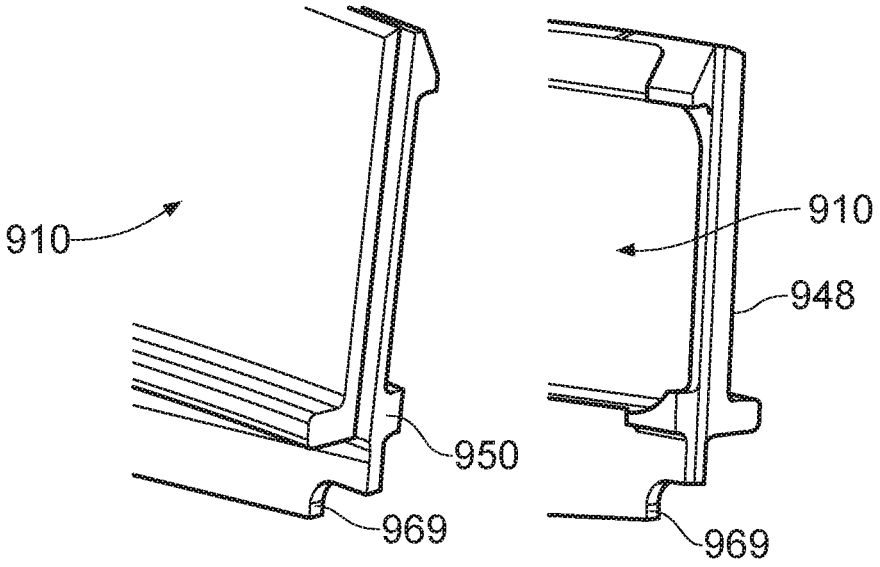
FIG. 9 shows respective outward and inward facing surface end edges of two adjacent lock plates.

FIG. 9 shows the edge portions of a lock plate 910 and the corresponding radially extending circumferential edges 948, 950 from axially forward and rearward facing directions. The two end surfaces shown are from the ends of a common or circumferentially adjacent lock plates.

Each of the lock plate edges 948, 950 include a rebate along its radial length to provide a flanged seat into which a corresponding edge from the circumferentially adjacent lock plate can be received. Hence, each lock plate has a rebate in the outwardly facing surface of one lock plate on one circumferential edge, and a rebate in the inwardly facing surface of the other circumferential edge.

Each of the radially inner circumferential edge corners of the lock plates include a corner notch 969. The notch 969 in the example is an approximate quarter round and provides an anti-rotation feature which mates with a corresponding feature on the seal plate or rotor disc. It will be appreciated that the anti-rotation function could be achieved with smaller notches than are presented in this example. However, providing notches with a greater radial extent allows for a larger seal fin and increased sealing functionality.

It will be understood that the invention is not limited to the described examples and embodiments and various modifications and improvements can be made without departing from the concepts described herein and the scope of the claims. Except where mutually exclusive, any of the features may be employed separately or in combination with any other features and the disclosure extends to and includes all combinations and sub-combinations of one or more described features.

The invention claimed is:

1. A turbine arrangement of a gas turbine engine, the turbine arrangement comprising:

a rotor comprising a disc which incorporates a plurality of circumferentially spaced turbine blades, each blade having an aerofoil extending from a platform and a root portion securing the blade to the disc, a lock plate located at an axial end of the root portion of the blade, the lock plate comprising:

a plate body having an inward facing surface which is located adjacent the blade root and an outward facing surface, radially inner and outer edge portions, and first and second circumferential edges, the inward facing surface and the outward facing surface both extending from the radially inner portion to the radially outer edge portion;

a head portion located at the radially outer edge portion of the plate body and located within a head portion slot provided at least partially by the turbine blade;

a foot portion located at the radially inner portion of the plate body and within a foot portion slot provided at least partially by the disc; and, a projection extending from the outward facing surface away from the turbine blade root in use, the projection being located closer to the foot portion than to the head portion, wherein:

the centre of gravity of the lock plate is axially spaced from the turbine blade root relative to the geometric centre of the lock plate or a pivot point defined by the head portion such that the lock plate moves away from the turbine blade root when centrifugally loaded.

2. A turbine arrangement as claimed in claim 1, wherein the foot portion slot is provided by a first wall and a second wall, the foot portion slot being therebetween, and wherein the second wall is at least partially provided by a seal plate or a cover plate which is attached to the rotor.

3. A turbine arrangement as claimed in claim 2, the projection is provided radially proximate to a radially outer periphery of the second wall.

4. A turbine arrangement as claimed in claim 3, wherein the axial extent of the projection is greater than the second wall.

5. A turbine arrangement as claimed in claim 3, wherein the radial separation of the projection and the radial periphery of the second wall is in the range of between 2 mm and 4 mm.

6. A turbine arrangement as claimed in any of claim 1, wherein the head portion slot is provided in the radially inner face of a blade platform.

7. A turbine arrangement as claimed in claim 1, wherein the head portion slot includes a pivot pad which radially opposes a pivot pad on the radial periphery of the lock plate head portion.

8. A turbine arrangement as claimed in claim 7, wherein the head portion includes a plurality of pivot pads on a radially outer edge thereof.

9. A turbine arrangement as claimed in claim 8, wherein radially outer edge of the lock plate includes a chamfer on either or both of the outward facing surface and the inward facing surface, the pivot pad being defined by the chamfer.

10. A turbine arrangement as claimed in claim 1, wherein the projection is an elongate rib protruding from the outward facing surface.

11. A turbine arrangement as claimed in claim 10, wherein the rib is circumferentially curved.

12. A turbine arrangement as claimed in claim 1, wherein the foot portion includes a seal fin located in the foot portion slot and the projection is located radially outwards of the seal fin.

13. A turbine arrangement as claimed in claim 12, wherein the seal fin includes a chordal inner edge.

14. A turbine arrangement as claimed in claim 12, wherein the seal fin is axially thinner than the plate body.

15. A lock plate of a turbine blade rotor in a gas turbine engine, the lock plate being provided adjacent to and covering a turbine blade root, the lock place comprising:

a plate body having an inward facing surface which is located adjacent the blade root and an outward facing surface, radially inner and outer edge portions, and first and second circumferential edges, the inward facing surface and the outward facing surface both extending from the radially inner portion to the radially outer edge portion;

a head portion located at the radially outer edge portion of the plate body;

a foot portion located at the radially inner portion of the plate body;

a projection extending from the outward facing surface away from the turbine blade root in use, the projection being located closer to the foot portion than to the head portion, wherein:

the in use centre of gravity of the lock plate is axially spaced from the turbine blade root relative to the geometric centre of the lock plate or a pivot point defined by the head portion such that the lock plate moves away from the turbine blade root when centrifugally loaded.

* * * * *